US005491949A

United States Patent [19]

De Moor

[11] Patent Number: 5,491,949

[45] Date of Patent: Feb. 20, 1996

[54] CROSS BRACING FOR WOODEN STRUCTURES

[75] Inventor: Charles H. De Moor, Dilbeek, Belgium

[73] Assignee: Hamon Thermal Engineers & Contractors S.A., Bruxelles, Belgium

[21] Appl. No.: 231,471

[22] Filed: Apr. 22, 1994

[30] Foreign Application Priority Data

Apr. 22, 1993 [BE] Belgium ..... 09300403

[51] Int. Cl.[6] ..... E04C 5/18; E04C 2/38

[52] U.S. Cl. ..... 52/657; 52/655.1; 52/693

[58] Field of Search ..... 52/693, 712, 167 CB, 52/167.3, 655.1, 656.9, 657; 403/260, 262

[56] References Cited

U.S. PATENT DOCUMENTS

| | | | |
|---|---|---|---|
| 652,292 | 6/1900 | Schild et al. | 52/712 |
| 2,141,888 | 2/1938 | Venzie | 52/712 |
| 2,964,807 | 12/1960 | Kennedy | 52/693 |
| 4,469,466 | 9/1984 | Hotz | 403/262 |

FOREIGN PATENT DOCUMENTS

| | | | |
|---|---|---|---|
| 2262433 | 7/1973 | Germany | 52/712 |
| 585825 | 3/1977 | Switzerland | 52/712 |

*Primary Examiner*—Carl D. Friedman
*Assistant Examiner*—Yvonne Horton-Richardson
*Attorney, Agent, or Firm*—Leydig, Voit & Mayer

[57] ABSTRACT

The invention relates to cross bracing for wooden structures, formed by vertical posts (21), horizontal beams (22) intersecting each other at junctions, braces (23, 24, 25) situated diagonally between two adjacent junctions, and gussets (35–40) which connect the braces to the beams and the posts. The braces comprise transverse grooves (41) near their ends, and the gussets comprise a heel (45) at least one of their ends which can engage in one of the grooves in the braces.

39 Claims, 4 Drawing Sheets

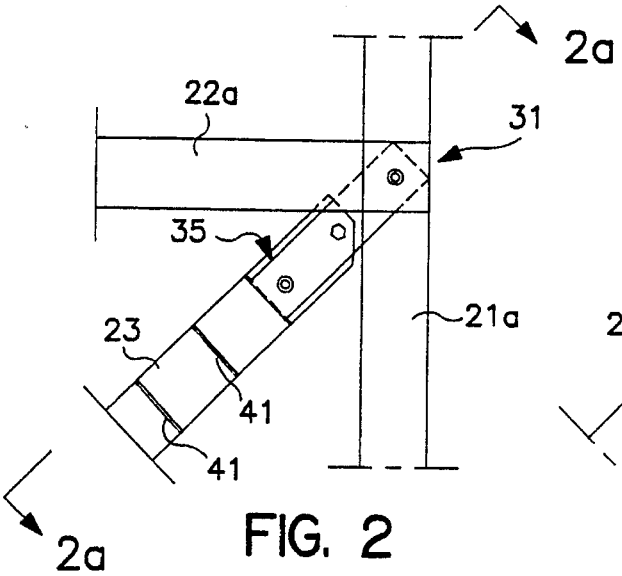
FIG. 2
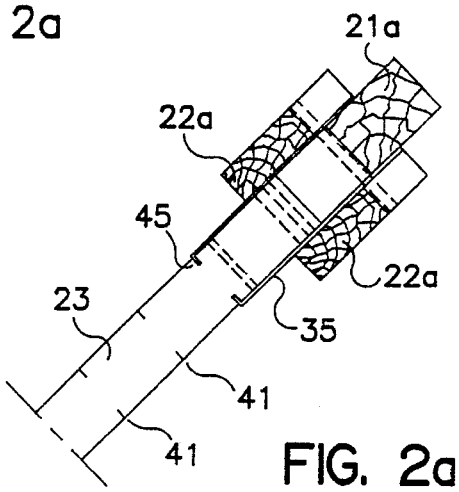
FIG. 2a
FIG. 3
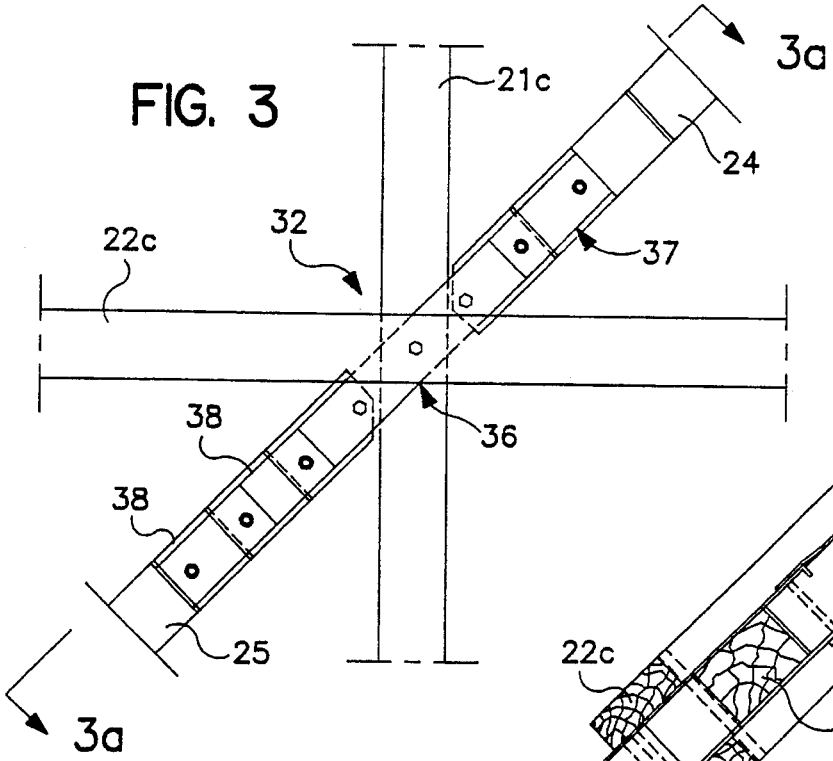
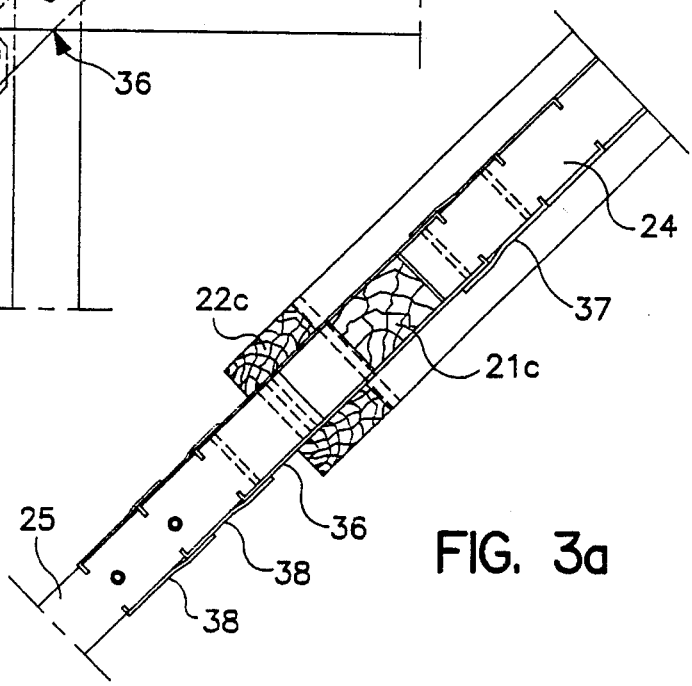
FIG. 3a

CROSS BRACING FOR WOODEN STRUCTURES

FIELD OF THE INVENTION

The present invention relates to cross bracing for wooden structures, and more particularly to structures used for atmospheric cooling apparatuses. Atmospheric cooling apparatuses are currently used in various industries and in the generation of electricity in order to recycle water which has been heated and has to be cooled, or to cool heated water before discharging it to the environment, or more generally for the cooling by ambient atmospheric air of water which is hotter than this air in order to use it in industrial processes.

BACKGROUND ART

The infrastructure of cooling apparatuses comprises an external infrastructure supporting the shell of the cooling apparatus, i.e, its outside walls and the roof which it may possess, and an internal framework supporting the lining of the cooling apparatus.

Numerous atmospheric cooling apparatuses have a wooden infrastructure, which may either be the external infrastructure, or the internal framework, or the system comprising the external infrastructure and the internal framework.

These wooden infrastructures are formed from wooden structures. These wooden structures essentially comprise posts (columns) and beams intersecting at junctions. In order to ensure the stability of this system of posts and beams, and in particular to ensure its resistance to winds and earth movements up to a certain limit, cross bracings are added to this system. These cross bracings obliquely connect the junctions. They are diagonal elements which increase the resistance of the structure to horizontal stresses, and together with the posts and beams they constitute the structural elements of the structure.

In general, posts and beams intersect at junctions and are continued on both sides of these junctions. Together with other posts and beams situated in the same approximate vertical plane, they form a grid. The structure comprises braces situated within this grid between two diagonally adjacent junctions, and by gussets which connect the braces to each other beyond the junctions and which connect them to the posts and beams.

The gussets are connecting plates which transmit the horizontal loads of the beams (forces, tensions, stresses) to the braces and to the posts. These loads essentially originate from the stresses due to the wind and due to earth movements, and from the loadings on the adjacent braces.

Hitherto, simple flat metal plates, which are relatively thick and which are drilled with a plurality of holes for the passage of bolts, have always been used as gussets. These metal plates are fixed to the braces by means of bolts, with the interposition of washers. These washers are flanged or serrated washers (claw washers) and penetrate the wood with their claws or flanges. They transmit the forces between the wood and the bolts by shear and compression. The bolts transmit the forces between the washers and the gussets by shear. When serrated washers are used, the claws, which end in a sharp point, are driven into the wood by force, for example by nailing or in a press. When flanged washers (shear washers) are used, a circular groove of the dimensions of the flange of the washer is previously cut in the wood and these washers are then embedded in the wood.

All the wooden components are cut, drilled, countersunk, etc. in a workshop specialising in woodwork, whilst the assembly is erected on site, where all the assembly hardware (gussets, washers, bolts, nuts, etc.) is delivered. These metal parts, which are subjected to stress, which are in a hot humid atmosphere and which are constantly wetted by water containing various dissolved salts, are made of stainless steel or of another relatively noble metal and are therefore expensive parts, particularly the bolts and washers, which are machined parts. When assembly is effected using serrated washers, embedding these washers in the wood is an operation which is costly on site.

The forces to which the braces are subjected are not the same for all the braces; they depend on the location of the brace in the structure. Moreover the load on a brace is greater the closer it is situated to the ground. Consequently, if one washer is sufficient to transmit the force from a brace to a gusset at the upper level of the tower, two of them are required, for example, at the intermediate level, and three are required at the lower level, or even more (for example two, four and six, respectively).

As a result, the assembly hardware will comprise various gussets of different lengths, depending on the number of holes which they must have in order to receive the requisite number of bolts supporting the special flanged or serrated washers.

In practice, when the claws or the flanges of the washers transmit forces to the wood by subjecting it to compression, of the order of 100 kg/cm$^2$, these forces are transmitted to the bulk of the brace in order to be propagated along the length of the latter, in practice by shear, of the order of 10 kg/cm$^2$ and is thus ten times less.

The differences in length between the various gussets are relatively great. They are sufficiently great that there are cogent economic reasons for not making all gussets to a standard length equal to the greatest length necessary.

SUMMARY OF INVENTION

The object of the present invention is to provide a simplified cross bracing having a lower hardware cost and a shorter time of assembly.

Another object of the invention is to provide greater standardization of the hardware, i.e. fewer different parts to be manufactured, stored and handled.

According to the invention the cross bracing is formed by braces comprising one or more transverse grooves near their ends, by gussets each comprising a heel at least one of their ends which can be engaged in one of the grooves in order to interlock the gussets with the wooden structure and to fix the gussets to the braces.

According to the invention, each gusset is one of three types, namely end gussets, extension gussets and inter-brace gussets. The end gussets have to fix the brace either to the anchorage sole piece or to a junction of the structure at the end of a beam. One end of this type of gusset is bent at an angle of about 90° to form a heel. The extension gussets, which are intended for reinforcing other types of gussets, each comprise a heel as well as an offset towards the middle of their length. The inter-brace gussets, which are intended for interlocking the braces on both sides of a junction, comprise a heel at each of their ends. The structure can thus be standardized and easily produced on site with a single type of brace and with these three types of gussets.

According to one advantageous embodiment of the invention, all the braces to be used in a cross bracing unit are identical. Preferably, they comprise a plurality of transverse grooves at their ends.

According to one preferred embodiment, the interlocking is achieved by a fixing means employing:

first bolts and corresponding nuts, which pass through the braces and the gussets and hold the gussets against the braces;

second bolts and corresponding nuts, which interlock the gussets, either with the structure of posts and beams at the junctions, or with the anchorage sole pieces of the posts.

In general, the first bolts can be smaller than the second bolts.

In addition, the fixing means advantageously comprise bushes to be used when a gusset is reinforced by an extension gusset. In this situation, the bush transmits the forces between adjacent gussets. Moreover, flat washers (backup rings) are used to hold the bushes in place.

These parts, i.e., the braces, three types of gussets, two types of bolts, the bushes and the washers, constitute all the parts necessary to produce a structure on site.

With the aim of facilitating assembly, the gussets will be provided with standard holes drilled in the factory. Thus, in one embodiment:

each end gusset has three holes:

a central hole for positioning the gusset against the brace;

a hole for fixing the gusset either to the anchorage sole piece or to a junction of the structure;

a hole for the possible installation of an extension gusset.

each inter-brace gusset has five holes:

two holes at the ends for the possible installation of an extension gusset;

a central hole for interlocking the gusset with a junction of the structure;

two holes on both sides of the central hole for positioning the gusset against the brace.

each extension gusset has two holes, for fixing the extension junction to another junction and to the brace.

In order to simplify manufacture in the factory, provision may be made for the distance between two adjacent holes to be the same for all the gussets.

Regarding length, the extension gussets are generally the shortest; the end gussets will have a length which will generally be slightly less than twice that of the extension gussets; the inter-brace gussets will have a length which will generally be slightly less than twice that of the end gussets.

The present invention also provides a kit of parts, comprising a plurality of and gussets, at least one extension gusset, and at least one inter-brace gusset. A preferred form of the kit also includes a plurality of braces.

BRIEF DESCRIPTION OF THE DRAWINGS

An embodiment of the present invention will now be described by way of example with reference to the accompanying drawings in which;

FIGS. 2, 3 and 4 are enlarged illustrations of the three parts which are circled in FIG. 1;

FIGS. 2*a*, 3*a* and 4*a* are views along the arrows A—A of FIGS. 2, 3 and 4;

DESCRIPTION OF THE PREFERRED EMBODIMENT

Figure 1:
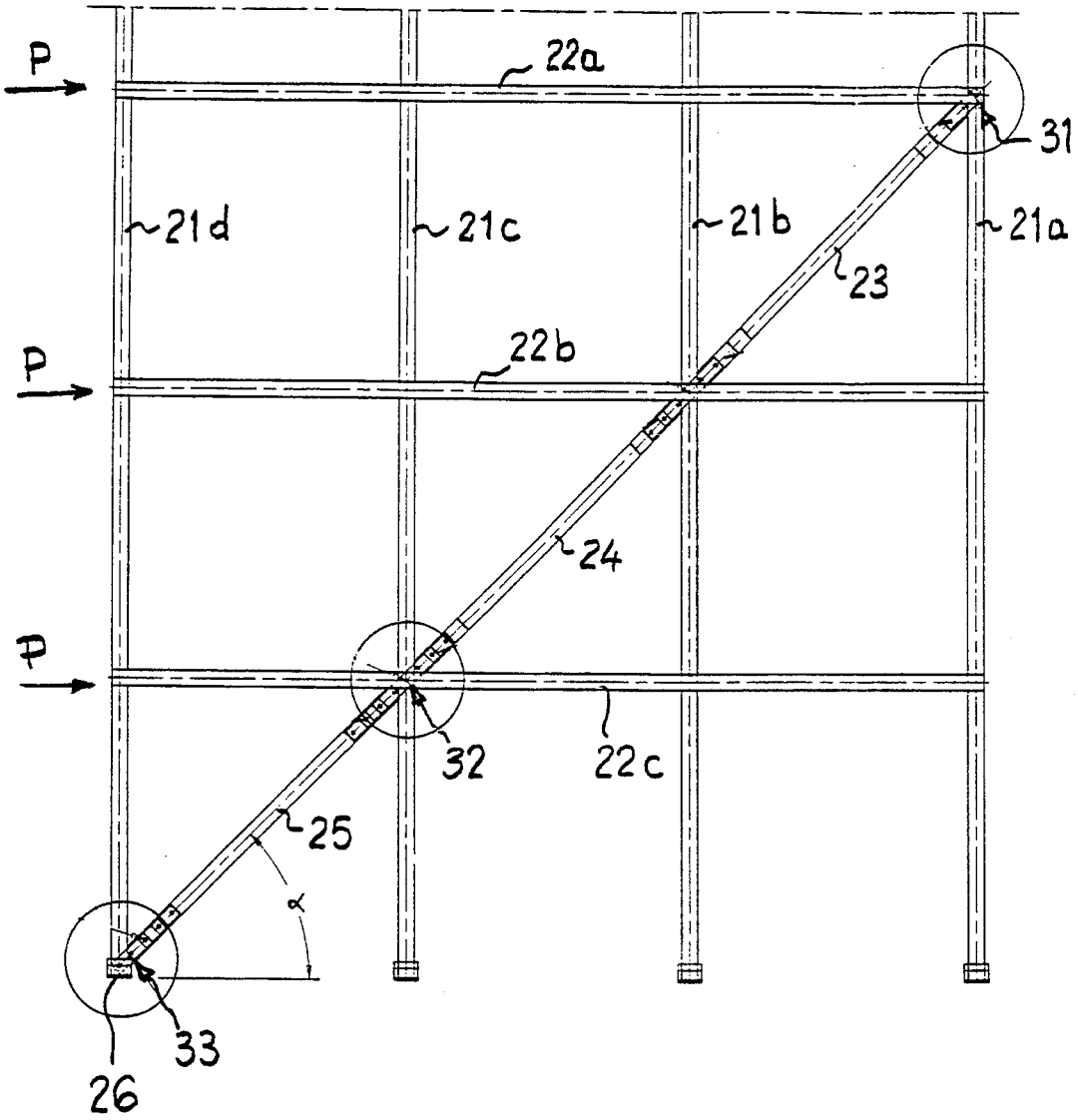
FIG. 1 is a schematic elevation of part of a structure.

Referring to FIG. 1, this shows part of a wooden structure formed by four posts 21*a*, 21*b*, 21*c* and 21*d*, three beams 22*a*, 22*b*, and 22*c* and three braces denoted by reference numerals 23, 24 and 25, respectively. In the example the three braces form a complete line of the structure.

The brace 23 is fixed to the junction 31 formed by the post 21 a and the beam 22*a* by means of end gussets which are described in detail below with reference to FIGS. 2 and 2*a*.

The brace 24 is fixed firstly to the junction formed by the post 21*b* and the beam 22*b* by means of inter-brace gussets and secondly to the junction 32 formed by the post 21*c* and the beam 22*c* by means of another inter-brace gusset. The inter-brace gussets are described in detail below with reference to FIGS. 3 and 3*a*.

Figure 4:
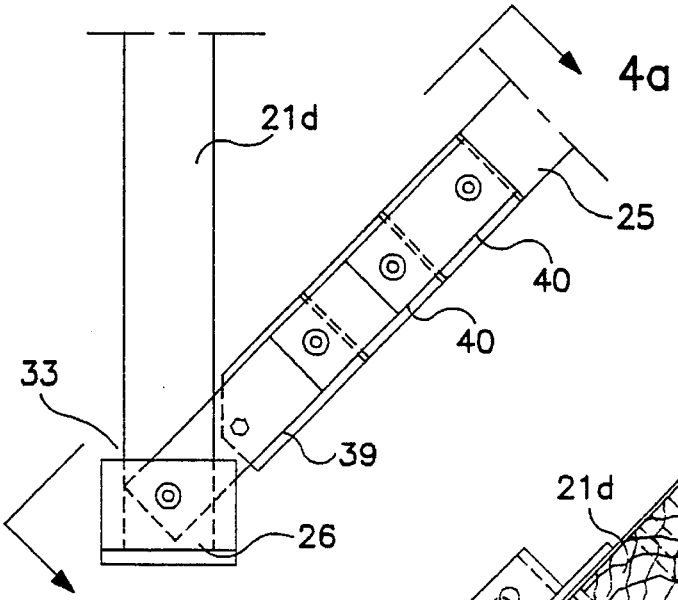
Figure 4A:
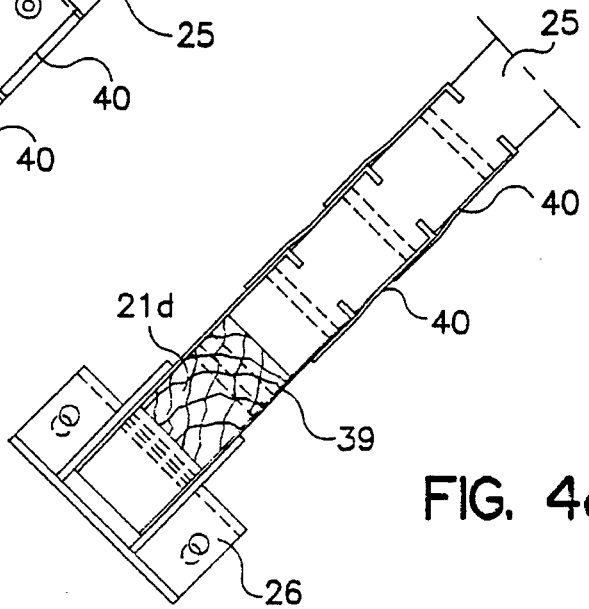

The brace 25 is fixed to the post 21*d* and to the anchorage sole piece 26 (junction 33) by means of end gussets illustrated in FIGS. 4 and 4*a*.

As shown in FIG. 1, the end gusset fixed to the junction 31 does not comprise an extension gusset, and the end gusset fixed to the junction 33 comprises two extension gussets.

This becomes clear if the force exerted on the braces is considered.

If P is a lateral force exerted on the part of the structure considered, and if, in this example, it is assumed that this force is constant over the height, i.e. is identical for the three beams, the thrust P in beam 22*a* produces a force "D" in brace 23, which is transmitted to brace 24, where it is added to the force transmitted to this brace by beam 22*b*. Brace 24 transmits a force "2D" to brace 25, which again receives a force D from beam 22*c*. The force in brace 25 is thus "3D" in this example.

Brace 23 is attached to junction 31 of the part of the structure considered by two end gussets (one on each side face), whilst its lower end connects it to the structure and to brace 24 via two inter-brace gussets. For this brace 23, which is subjected to the least stress, the sizing of the elements present is such that no extension gusset is necessary if an end gusset absorbs a force "0.5D".

In contrast, brace 24, which is acted upon by a force "2D", has two extension gussets at each of its ends, one for each side face of the brace; each extension absorbs a force "0.5D".

Finally, brace 25 receives three gussets for each side face, two of which are extension gussets. At the upper end of the brace the latter are connected to an inter-brace gusset, whilst at the lower end they are connected to an end gusset. There are therefore six gussets at each end, each transmitting a force "0.5D", the addition of which just corresponds to the force "3D" of the brace.

FIGS. 2 and 2*a* show, on a larger scale, the junction 31 formed by the post 21*a*, the beam 22*a* and the brace 23. Brace 23 has three transverse grooves or notches 41 at its end, on two opposite faces. These grooves 41 are produced in the joinery shop. They are equidistant from each other and are formed over the entire width of the brace. For reasons of standardization of manufacture and of interchangeability on the construction site, the number of cuts in each brace is preferably equal to the maximum number which the most heavily loaded brace must have. In the example, each brace has twelve cuts (in three places on two opposite faces at each end).

Figure 5:
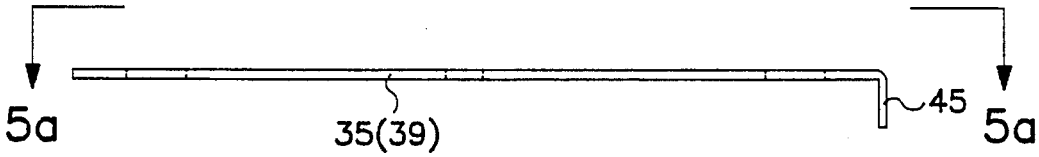
FIGS. 5, 6 and 7 are side views of three types of gussets.
Figure 5A:
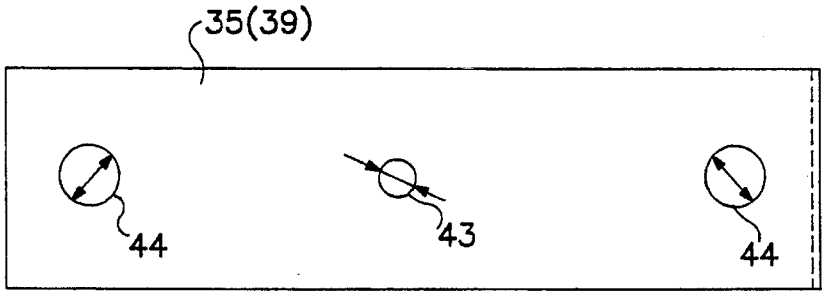
FIGS. 5*a*, 6*a* and 7*a* are views along the arrows of FIGS. 5, 6 and 7, respectively.

Junction 31 is interlocked (on its two opposite faces) by means of end gusset 35. This gusset is a metal plate cut to form a rectangle, which is bent at one end to form the heel 45 and which is drilled with holes for the passage of bushes and bolts. In the example the gusset has three holes (FIG. 5).

FIGS. 3 and 3*a* show the junction 32 formed by post 21*c*, beam 22*c* and braces 24 and 25. The junction is interlocked (on its two opposite faces) by means of an inter-brace gusset 36, and is reinforced at the end of brace 24 by an extension gusset 37 and at the end of brace 25 by two extension gussets 38. Each inter-brace gusset 36 has a heel 45 at each end and is drilled with five holes (FIG. 6).

Figure 7:
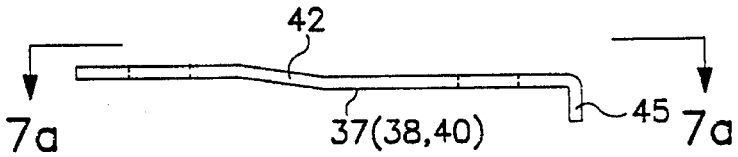
Figure 7A:
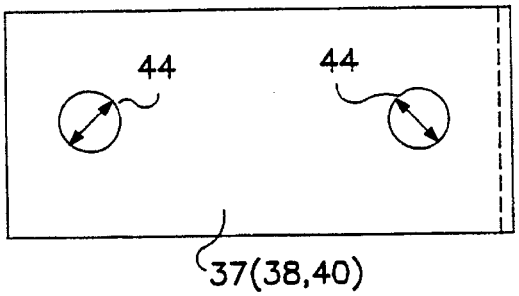

Each extension gusset (37–38) comprises a heel 45 at one end, an offset 42 towards the middle of its length, and two holes, one on each side of the offset (FIG. 7).

FIGS. 4 and 4*a* show the junction 33 formed by post 21*d*, anchorage sole piece 26 and brace 25. The junction is interlocked (on its two opposite faces) by means of an end gusset 39 and two extension gussets 40.

Figure 6:
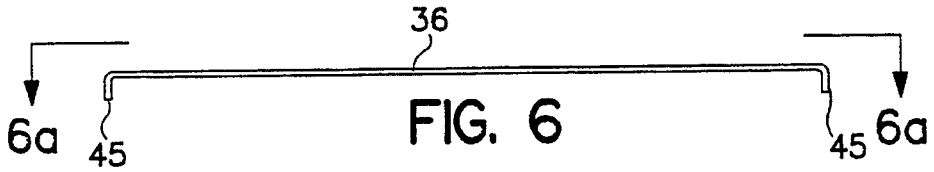
Figure 6A:
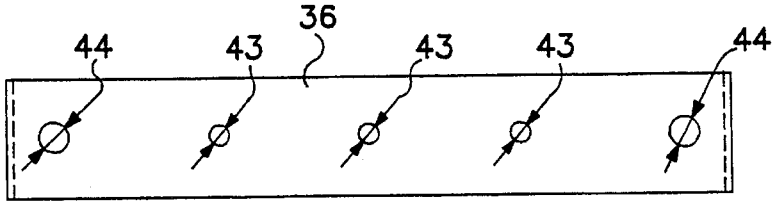

FIGS. 5, 6 and 7 show an example of each type of gusset in detail. By way of example, these parts may have the following dimensions. Thus the thickness of the base metal plate is 4 mm, the height of the heel is 15 mm and the width of the gussets is 80 mm, the latter value being equal to the smallest width of the side face of the brace which receives gussets. A brace may be wider than the gusset, but in principle the gussets should never protrude beyond the braces.

Figure 8:
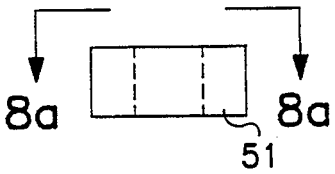
FIGS. 8 and 8*a* are a side view of a bush and a view along the arrows A—A of FIG. 8, respectively.

The holes in the gussets have diameters of 22 mm when they have to be able to receive bushes 51, the outside diameter of which is then also 22 mm, the tolerances on these diameters being such that the bushes can be introduced manually, without looseness, into pairs of gussets. This is the case for the end holes 44 of the gussets. The other holes 43 have a diameter of 14 mm in order to be able to receive either bolts of 12 mm diameter, namely those of the junctions and anchorages of the structure, or bolts of 8 mm diameter intended for holding parts. The inside diameter of the bushes 51 is then 10 mm if the same diametric clearance is desired as for the 12 mm bolts (FIG. 8).

The large washers 52 (FIG. 9) have an inside diameter equal to the inside diameter of the bushes 51 and an outside diameter of 25 mm, which is substantially greater than that of the bushes, so that they can be clamped against the gussets and can thus hold the bushes in place, the thickness of the bushes being equal to that of two gussets, or 8 mm.

The offset 42 of the extension gusset is 4 mm thick, corresponding to the thickness of the sheet metal of the gussets.

The thickness of the large washers is not critical. It may be equal to that of the gussets (2 mm) or thinner.

Referring again to FIG. 5, it will be observed that the end gusset 35 comprises a heel 45, two large diameter holes 44 and one small diameter hole 43, these three holes being aligned along the centre line of the gusset. The hole 44 at the opposite end to the heel 45 is intended for fixing to the junction 31 by means of a large bolt.

In the case of the end gusset 39, the hole 44 at the opposite end to the heel 45 is intended for fixing to the anchorage sole piece 26. A bush 51 and a small bolt are used for this purpose.

The central hole 43 is intended for the passage of a small bolt for positioning gusset 35 against brace 23 or gusset 39 against brace 25, respectively.

The large diameter hole 44 near the heel 45 will receive a bush 51 if an extension gusset is used (as in the case of the end gusset 39 with two extension gussets 40); a small bolt will be passed through it. Even in the case where an extension gusset is not used (as is the case for gusset 35), a small bolt will also be used because the forces between the brace and the gusset are transmitted by the heel and not by the bolt, which merely serves to immobilize and interlock the elements present.

As shown in FIG. 6, an inter-brace gusset has a heel at each end and is drilled with five holes.

Two large holes 44 will be observed at the ends for receiving bushes 51 when extension gussets are required, as is the case for the inter-brace gusset 36 and the extension gussets 37 and 38. Small bolts pass through these holes; these bolts are simply intended for positioning the gussets against the braces.

In addition, gusset 36 comprises three small diameter holes 43, the central hole of which receives a large bolt which transmits the forces between the gusset 36 and the structure of posts and beams; the holes adjacent to the central hole receive small bolts for positioning the system and for reducing the buckling stress on the gusset.

FIG. 7 shows the extension gusset 37 (38 or 40). It has a single heel 45 at one end and a shoulder (or offset) 42 towards the middle of its length.

This offset 42 is intended to overlap another gusset (either an end gusset, or an inter-brace gusset, or another extension gusset). The height of the offset is equal to the thickness of the gusset. The part of the gusset between the heel and the offset is applied to the wood of the brace via one of its faces. The other face of this part of the gusset is either not in contact with anything when this gusset terminates a series of gussets (as opposed to the end of a brace) or receives the shoulder of another extension gusset. These extension gussets are only provided with two holes, each of large diameter, the hole in the shoulder receiving a bush for the transmission of force to another gusset, and the hole adjacent to the heel receiving a bush when this extension gusset is connected there to another extension gusset. The bolts which pass through the holes of these gussets are small bolts only, because they never transmit the forces of the brace but simply serve to apply the gussets against the braces and to hold the bushes in place (with the aid of their flat washers 52 and their bolts).

If the gusset terminates a series of gussets, the hole on the heel side may be smaller, but it would then have two types of extension gusset, which would make maintenance, storage and assembly more onerous without any benefit.

FIG. 8 shows a bush 51, the axial thickness of which is equal to twice the thickness of the gussets. The wall of the bush is relatively thick, so that it is able to transmit, by shear, the force between the two gussets connected by the bush. The outside diameter of the bush corresponds to the diameter of the large holes (44) in the gussets so that it can be accommodated therein without looseness. The inside diameter of the bush is dimensioned in order to receive the small bolts. A bush connects an extension gusset to another gusset comprising one or other of the three types of gusset.

Figure 9:
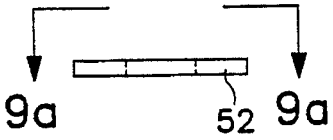
FIGS. 9 and 9*a* are a side view of a back-up ring and a view along the arrows A—A of FIG. 9, respectively.
Figure 8A:
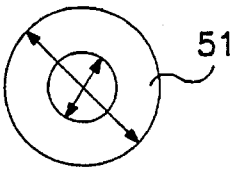
Figure 9A:
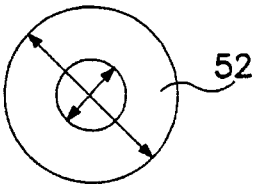

FIG. 9 shows a flat washer 52, which completes the connection at the bushes 51. These washers are placed between the nut or the head of the bolt and the gusset; they are parts with an inside diameter corresponding to a small bolt (with a clearance), and with an outside diameter which is larger than the outside diameter of the bushes 51, so that they can be applied to the gusset and can thus clamp the pair of gussets against the brace and hold the gussets and braces in place.

It is clear that the invention is not restricted to the example described above, and that variants can be found for the design of the parts.

The advantages of using a gusset with a heel are apparent when it is realized that the heel of a gusset absorbs almost the force of three large bolts of a classical structure. It therefore reduces the labour cost and the materials cost. In practice, three bolts with flanged washers or serrated washers are distinctly more expensive than is the production of a heel.

The holes and cuts in the braces according to the invention are rapidly produced in succession in the joinery shop (which does not receive the assembly hardware) on the same machine without gripping and re-gripping the braces, whilst serrated washers of the prior art have to be laboriously driven into the braces on site, which is a much more laborious operation than the simple placement on site of the heels in the grooves (notches) which have previously been cut in the joinery shop.

Moreover, compared with the classical system with serrated washers, the invention also has the advantage of causing less damage to the wood and of providing cleaner surfaces for contact with the metal parts to which the forces are transmitted.

What is claimed is:

1. A kit of parts for bracing a structure, the structure comprising substantially vertical posts and substantially horizontal beams intersecting the posts at junctions, the kit comprising:

at least one brace for disposition diagonally between two diagonally adjacent junctions of the structure and having at least one transverse groove in the vicinity of each end;

at least one end gusset for attaching the brace to a junction of the structure, each end gusset comprising a heel at one end;

at least one inter-brace gusset for attaching the brace to a similar brace, the two braces disposed substantially collinearly on opposite sides of a junction of the structure, each inter-brace gusset comprising a heel at each end; and at least one extension gusset for reinforcing another gusset while overlapping the reinforced gusset, each extension gusset comprising a heel at one end, the heel of each gusset being shaped to be engaged in the groove of each brace.

2. A kit of parts according to claim 1, wherein each end gusset has at least one hole to permit (i) locating the gusset against the brace, (ii) fixing the gusset to one of the junctions of the structure and (iii) the attachment of an extension gusset.

3. A kit of parts according to claim 1, wherein each inter-brace gusset has at least one hole to permit (i) locating the gusset against the brace, (ii) fixing the gusset to one of the functions of the structure and (iii) the attachment of an extension gusset.

4. A kit of parts according to claim 1, wherein allowing the extension gusset to overlap the reinforced gusset and at least one hole formed in the offset portion for fixing the extension gusset to the reinforced gusset and to the brace.

5. A kit of parts according to claim 4 including a bush sized to fit in the hole in the extension gusset.

6. A kit of parts according to claim 2, wherein the end gusset includes a first hole and a second hole smaller in diameter than the first hole.

7. A kit of parts according to claim 3, wherein the inter-brace gusset includes a first hole and a second hole smaller in diameter than the first hole.

8. A kit of parts according to claim 4, wherein the extension gusset includes first and second holes having a common diameter.

9. A kit of parts according to claim 1 wherein the end gusset includes a first hole having a first diameter and a second hole having a second diameter smaller than the first diameter, the inter-brace gusset includes a first hole having the first diameter and a second hole having the second diameter, and the extension gusset includes two holes having the first diameter.

10. A kit of parts according to claim 9, wherein the two hole in each gusset are separated by a common spacing.

11. A kit of parts according to claim 9 including a plurality of bushes sized for insertion into the holes of the first diameter and having a thickness equal to approximately a combined thickness of two of the gussets.

12. A kit of parts according to claim 1, wherein the brace has a rectangular cross-section and two opposite faces each containing one of the transverse grooves.

13. A kit of parts according to claim 1, wherein the heel of each gusset is formed by bending one end of the gusset.

14. A kit of parts according to claim 13 wherein the heel is bent by 90°.

15. A kit of parts according to claim 1, comprising a plurality of substantially identical braces each having transverse grooves on two opposite faces of its ends.

16. A structure comprising substantially vertical posts and substantially horizontal beams intersecting the posts at junctions, at least one diagonal brace extending diagonally between two of the junctions, and at least one gusset connecting the brace to one of the junctions, the brace and the gusset being from a kit of parts according to claim 1.

17. A method of cross bracing a structure having substantially vertical posts and substantially horizontal beams intersecting the posts at a plurality of junctions, the method comprising:

diagonally disposing a brace having first and second ends between two of the junctions; and connecting the first end of the brace to one of the junctions with a first gusset plate having a heel engaged with a first groove formed in the brace.

18. A method according to claim 17 including reinforcing the first gusset plate with an extension gusset plate having a heel engaging a second groove formed in the brace and an offset portion overlapping the heel of the first gusset plate.

19. A method according to claim 18 including securing the first gusset plate to the extension gusset plate by a bolt passing through the first gusset plate, the offset portion of the extension gusset plate, and the brace, and by a bushing surrounding the bolt and simultaneously engaging bolt holes in both gusset plates.

20. A method according to claim 18 comprising reinforcing the extension gusset plate with another extension gusset plate having a heel engaging a third groove formed in the brace and an offset portion overlapping the heel of the one extension gusset plate.

21. A method according to claim 17 including simultaneously connecting the first gusset plate to two collinear braces on opposite sides of the one of the junctions by engaging a heel formed on each end of the first gusset plate with a corresponding first groove formed in each brace.

22. A method according to claim 17 including connecting the first gusset plate to a sole plate of the structure.

23. A kit of parts for bracing a structure having a plurality of substantially vertical posts and a plurality of substantially horizontal beams intersecting the posts at junctions, the kit comprising:

at least one brace for extending diagonally between two diagonally adjacent junctions of the structure, the brace having first and second ends and a plurality of transverse grooves formed at each end, each groove formed in a first of two opposite faces of the brace and extending transversely with respect to a length of the brace;

a substantially L-shaped end gusset having a substantially flat body with a bolt hole formed therein, and a heel attached to one end of the body and shaped to engage with one of the grooves in the brace;

a substantially C-shaped inter-brace gusset having a substantially flat body with a bolt hole formed therein, and first and second heels attached to opposite ends of the body, each heel shaped to engage with one of the grooves in the brace;

an extension gusset having first and second substantially flat portions offset from one another in different planes, and a heel attached to end of the first portion shaped to engage with one of the grooves in the brace, the second portion having a bolt hole formed therein; and a plurality of bolts sized to engage the bolt holes of the gussets for bolting the gussets to the brace.

24. A kit according to claim 23 wherein the brace includes three of the transverse grooves formed at each of its ends.

25. A kit according to claim 23 wherein each gusset includes a plurality of bolt holes separated by a common spacing.

26. A kit according to claim 23 wherein the body of the end gusset and the inter-brace gusset have a common thickness, and the first and second sections of the extension gusset are offset from each other by approximately the thickness.

27. A kit according to claim 23 including a bushing sized to simultaneously fit into the bolt hole in the extension gusset and the bolt hole in one of the other gussets and having a hole sized to receive one of the bolts.

28. A kit according to claim 23 wherein the bushing has a thickness approximately equal to a thickness of the second portion of the extension gusset and the thickness of one of the other gussets.

29. A kit according to claim 23 wherein the brace includes an additional plurality of transverse grooves formed at each end of the brace in the second of the two opposite faces and extending transversely with respect to the length of the brace.

30. A kit according to claim 23 wherein the kit includes a plurality of substantially identical braces each having three transverse grooves formed in a first of two opposite faces of the brace at each end of the brace.

31. A kit of parts for bracing a structure having a plurality of substantially vertical posts and a plurality of substantially horizontal beams intersecting the posts at junctions, the kit comprising:

a diagonal brace extending diagonally between two junctions of the structure located at different elevations, the brace having first and second ends, first and second opposite vertical faces extending between the ends, and a plurality of grooves formed in the first face at the first end, each groove extending transversely with respect to a length of the brace; and a first gusset having a substantially flat body and a heel attached to the body, the body overlapping the first end of the brace in a lengthwise direction of the brace and bolted to the first face of the brace and to the junction, the heel engaging one of the grooves in the first face.

32. A kit according to claim 31 comprising a second brace having a body and a heel attached to the body, the body comprising a substantially flat first portion bolted to the brace and a substantially flat second portion offset from a plane of the first portion and overlapping the body of the first gusset and bolted to the first gusset and the brace, the heel of the second brace engaging one of the grooves in the first face of the brace.

33. A kit according to claim 31 wherein the first gusset is substantially L-shaped.

34. A kit according to claim 31 wherein the first gusset is substantially C-shaped with first and second heels attached to opposite ends of the body.

35. A kit according to claim 32 wherein the heel of each gusset extends at approximately a right angle with respect to the body of the gusset.

36. A kit according to claim 32 wherein the first and second portions of the second gusset are offset from each other by approximately a thickness of the body of the first gusset.

37. A wooden structure comprising:

a pair of substantially vertical wooden posts having upper and lower ends;

a substantially horizontal wooden beam extending between the upper ends of the posts and defining a junction with one of the posts;

a wooden brace extending diagonally between the junction and the lower end of one of the posts, the brace having an upper end with a plurality of transverse grooves formed in a substantially vertical face thereof; and a first gusset plate securing the brace to the junction, the first gusset plate comprising a substantially flat body and a heel attached to an end of the body, the body being bolted to the brace and to the junction and the heel engaging one of the grooves in the brace.

38. A structure according to claim 37 wherein the body of the first gusset lies flat against the face of the brace.

39. A structure according to claim 37 comprising a second gusset having a body and a heel attached to an end of the body, the body having a substantially flat first portion disposed against the face of the brace and a substantially flat second portion offset from a plane of the first portion and overlapping the body of the first gusset, the first portion being bolted to the brace, the second portion being bolted to the brace and to the body of the first gusset, the heel engaging one of the grooves in the brace.

* * * * *

UNITED STATES PATENT AND TRADEMARK OFFICE

CERTIFICATE OF CORRECTION

PATENT NO. : 5,491,949

DATED : February 20, 1996

INVENTOR(S) : De Moore

It is certified that error appears in the above-indentified patent and that said Letters Patent is hereby corrected as shown below: Title page, Item 56: References Cited (U.S. Patent Documents); insert

-- 2,416,371 2/1947 WALTER BOCKIUS ..... 20/92

3,078,080 2/1963 JACK M. SLOUGH ..... 261/109 --,

Item 56: References Cited (Foreign Patent Documents): insert

-- 1146 1/1915 Netherlands .....

2647161 5/1989 France .....

0388221 9/1990 EPO ..... --,

Column 8; Line 18, change "hole" to --holes--.

Signed and Sealed this

Twenty-third Day of July, 1996

Bruce Lehman

*Attest:*

BRUCE LEHMAN

*Attesting Officer*

*Commissioner of Patents and Trademarks*